United States Patent [19]

Lieberman et al.

[11] Patent Number: 4,779,865

[45] Date of Patent: Oct. 25, 1988

[54] EXERCISE/THERAPY SUPPORT SYSTEM

[76] Inventors: David E. Lieberman, 182 Marylinn Dr., Milpitas, Calif. 95035; G. Mark Remelman, 4925 Omar St., Fremont, Calif. 94538

[21] Appl. No.: 60,403

[22] Filed: Jun. 11, 1987

[51] Int. Cl.[4] ..... A63B 21/24

[52] U.S. Cl. ..... 272/129; 272/118; 73/379

[58] Field of Search ..... 272/118, 129, 130, DIG. 5, 272/DIG. 6, 134, 125; 73/379

[56] References Cited

U.S. PATENT DOCUMENTS

| | | | |
|---|---|---|---|
| 3,848,467 | 11/1974 | Flavell | 272/DIG. 5 X |
| 4,063,726 | 12/1977 | Wilson | 272/130 |
| 4,184,678 | 1/1980 | Flavell et al. | 272/129 |
| 4,235,437 | 11/1980 | Ruis et al. | 272/130 X |
| 4,354,676 | 10/1982 | Ariel | 272/129 |
| 4,566,692 | 1/1986 | Brentham | 272/130 |
| 4,571,682 | 2/1986 | Silverman et al. | 272/129 X |
| 4,601,468 | 7/1986 | Bond et al. | 272/130 |
| 4,691,694 | 9/1987 | Boyd et al. | 272/129 X |

FOREIGN PATENT DOCUMENTS

| | | | |
|---|---|---|---|
| 0659158 | 4/1979 | U.S.S.R. | 272/DIG. 5 |

*Primary Examiner*—Richard J. Apley
*Assistant Examiner*—Robert W. Bahr
*Attorney, Agent, or Firm*—Kolisch, Hartwell & Dickinson

[57] ABSTRACT

An exercise/therapy support system useable with a personal-exercise-type machine. A sonar ranging device monitors motion in the machine during exercise to produce an exercise-related, visual display which is compared, in real-time, with a preprogrammed, selected-exercise-regime display. Post-exercise data can be made available for analysis.

3 Claims, 1 Drawing Sheet

EXERCISE/THERAPY SUPPORT SYSTEM

BACKGROUND AND SUMMARY OF THE INVENTION

This invention pertains to an exercise/therapy support system, and more particularly to such a system which is programmable and is useable with conventional exercise apparatus to guide actual, personal exercise activity through the use of a comparative motivational display.

In the recent past, there has been an enormous increase in the interest which people pay to regular personal exercise. Accompanying this growing interest has been a rapid and prolific development of personal exercise apparatus of all sorts and varieties which offer compact, convenient and versatile exercise opportunities.

Not only is there a widespread interest in performing non-therapeutic exercise employing such apparatus, but also there is a large population of people who, because of injuries, sickness, or other reasons, require therapeutic exercise to restore, or to promote restoration of, normal limb and joint movement and articulation.

The present invention, in this setting, proposes a unique exercise/therapy support system which offers comparative motivational guiding for actual personal exercise activity performed on apparatus of the type generally mentioned.

According to a preferred embodiment of the invention a position and motion sensor, preferably sonar-based, is attached to the frame of conventional exercise apparatus in a position where it can monitor the position and movement of a part in the apparatus which moves in a known relationship to exercise activity performed on the apparatus. In most cases, this part takes the form of the typical weight stack which moves up and down during exercise.

The output signal from this sensor, which is interpretable to indicate user exercise activity, effects the generation of a visual display, for example by way of a conventional light bar, that indicates in real-time the actual movement which a user is engaging during exercise. The total range of movement which is displayable by this display is adjustable and selectable. For example, if, in connection with a particular exercise regime, the user is capable of some known full range of movement, the real-time display of actual performance can be selected to correspond its limits to the limits of the full range of motion capability, or, if desired, to any selected sub-portion of that full range of motion.

Provided along with this first-mentioned display is another like visual display which is programmable to present to the user a real-time presentation of a desired, selected exercise regime. Thus, what appears on this display may be programmed to show, for example, in real-time, rate and timing of motion which is desired for, say, the "weight-lifting" portion of an exercise cycle, perhaps a pause thereafter, and then the motion and time parameters selected for the "weight-lowering" portion of an exercise cycle. Rests between successive cycles can also be programmed, as well as a number of other features which will be discussed more fully below.

According to the preferred embodiment of the invention which is described herein, programming can be accomplished either through the keypad entry of exercise parameters, or through the use of a microprocessor which monitors an actual exercise cycle performed by a user, which cycle is then employed to set the parameters for the motivational guidance display.

According to one modification of the invention which is possible where a microprocessor is employed, comparative data which have been used to generate the two display signals can be accumulated and processed to produce output charting signals that may be supplied to a printer for the purpose of producing a hard-copy analysis report of an exercise session. This modified feature offers an important tool to therapists monitoring and directing an exercise therapy program.

Still another modification of the invention which is mentioned herein excludes the use of a microprocessor, and relies for programming of the motivational guidance signal on keypad or other suitable manual entry.

Other important advantages which are offered by the system will become more fully apparent as the detailed description which now follows is read in conjunction with the accompanying drawings.

DETAILED DESCRIPTION OF THE INVENTION

Figure 1:
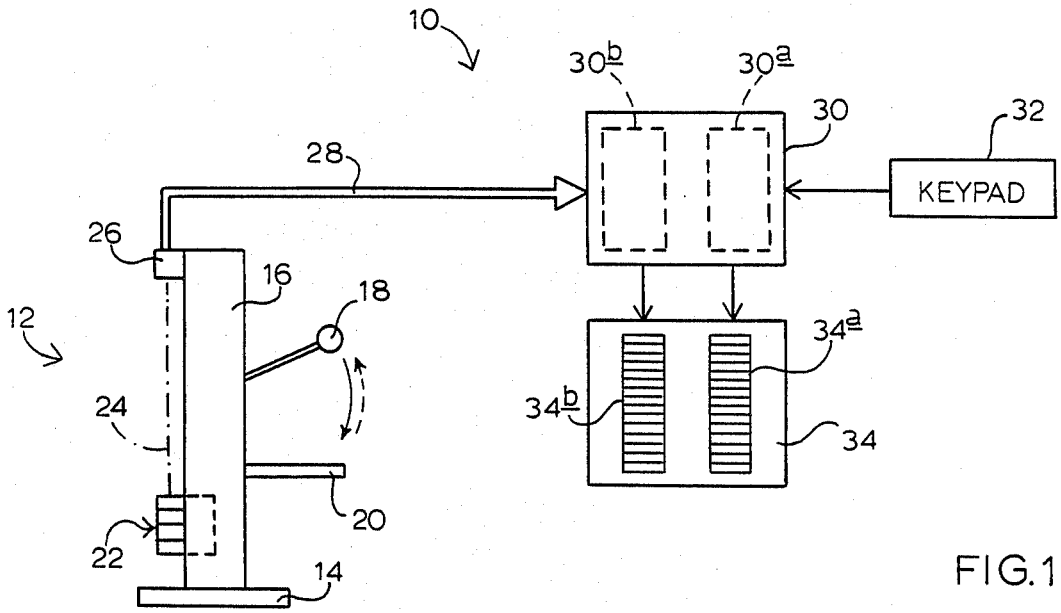
FIG. 1 is a simplified schematic/block diagram illustrating the exercise/therapy support system constructed in accordance with the present invention "coupled" for use in conjunction with a conventional personal exercise machine (apparatus).

Turning now to the drawings, and referring first to FIG. 1, indicated generally at 10 is an exercise/therapy support system constructed in accordance with the present invention shown in its intended, operatively coupled association with a conventional exercise machine (apparatus) 12 of the type generally outlined above. Machine 12 is shown only in very simplified schematic form, inasmuch as its details of construction, with the exception of the presence of a particularly kind of moving part which will be explained, form no part of the present invention. In general terms, machine 12 has a frame including a base 14, and an upright stand 16, on which the various moving parts of the apparatus are suitably mounted. In machine 12, there is shown a moveable exercise lever 18 which is swingable vertically above a user-support seat 20. Downward swinging of lever 18 raises a weight stack 22 vertically along an axis 24. Upward swinging of the lever lowers this stack. The stack, of course, is of a conventional design allowing weight units to be added or subtracted, thus to control the gross weight of the moveable portion of the stack. In the present setting, stack 22 is referred to as a part in machine 12 which moves in direct relationship (distance and speed) to the motion of lever 18, and thus in direct relationship to the exercise motion performed by a user.

Those skilled in the art familiar with various exercise machines like machine 12, will recognize that, in substantially all of them, there is a weight stack which moves like stack 22, or at least some other part of the apparatus which moves linearly in direct relation to a user's exercise motion. The system of the invention takes advantage of such a moving part, like stack 22, to offer the various important features and advantages suggested earlier.

Included in system 10 is a position and motion sensor 26 which preferably is a conventional commercially available sonar-type sensor. Sensor 26 is suitably mounted, as by clamping, to an upper portion of stand 16 in a position where it can "look" downwardly along axis 24 directly at the top of stack 22. With up and down movement of the stack, this sensor, as will be explained, produces an output signal which is directly interpretable to indicate both the speed of motion of the stack and the position of the top of the stack relative to a defined data plane in the sensor.

While there are many ways in which sensor 26 can be operated, we have chosen to employ it in a pulsed mode of operation, wherein, approximately every 20-milleseconds, it transmits a burst of seven audio pulses at the frequency of about 50-kilohertz. The interval between successive bursts is what might be thought of as a "receive" interval, during which return information is indicative of a position of the top of stack 24 relative to the mentioned data plane in sensor 26. Changes in position of the stack between successive pulse bursts is, of course, interpretable to indicate motion and rate of motion.

Preferably, and by any suitable conventional technique well known to those skilled in the art, the output signal from sensor 26, referred to herein as a sensor signal, is provided in digital form on a bus 28.

As was mentioned earlier, the system of the invention can have several modified forms of construction. The preferred embodiment described herein, in addition to the structure already mentioned, includes a digital computer 30, a keypad 32 suitably and conventionally coupled to computer 30, and a visual display unit 34 which is also coupled, as will be explained, to the computer. Unit 34 is also referred to herein as a comparison-enabling display means.

Included within computer 30 is what might be thought of as a computer subsection **30*a* which is programmable, as will be explained, to generate what is referred to herein as a first displayable signal which is fed to display unit 34 for presentation on a conventional light bar 34*a*. As will be discussed more fully shortly, what is programmed for display on bar 34*a*** is a time and motion pattern which reflects exercise parameters for a selected, desired exercise regime (the motivational display).

Also included within computer 30 is another subsection **30*b* which responds to real-time signals presented over bus 28, to generate what is referred to herein as an second displayable signal that is fed to display unit 34 for display by a light bar 34*b* which is like previously mentioned light bar 34*a*. Bar 34*b* is capable of presenting a visual display that reflects position and motion during a real-time actual exercise performed by a user of machine 12**.

Display unit 34 is constructed in such a manner that it is clearly viewable by the user of machine 12. The light bars in unit 34 may, of course, be organized in any associated pattern, but we have found it preferable to have them organized as side-by-side, adjacent vertical displays. Of course, while light bars have been chosen for the system illustrated herein as a preferred form of the system, other kinds of visual displays may be used.

Referring now to the programming of a selected, desired exercise regime, vis-a-vis time and motion, a typical regime might include a pre-chosen number of exercise cycles, defined, as will be explained, and organized into a pre-chosen number of sets of cycles, with preselected rest intervals between successive sets. Within each set of cycles, a given cycle would typically include a time to perform positive motion (weight lifting), a time to hold at the end of positive motion, a time to perform negative motion (weight lowering), and a time to hold at the end of negative motion. These times may, of course, all be different if so desired.

In system 10 illustrated herein, two ways are provided for accomplishing such programming. According to one way, exercise parameters are entered by way of keypad 32. Those skilled in the art will understand immediately how to establish a suitable protocol for the entry of parameters of the type outlined above, and accordingly, no details of a protocol are spelled out herein, since as they form no part of the present invention.

Another way of accomplishing the desired exercise regime parameter programming is through employing computer 30 to interpret the performance of a single exercise cycle conducted by a user, via signal information received over bus 28, thus to establish the required displayable signal which will be fed to light bar **34*a*. In other words, in such a mode of programming, a user of machine 12 carries out a single cycle of an exercise pattern, including the positive and negative motion and rest times, and the resulting signal provided on bus 28 is employed by computer 30 to program itself, to create a matching displayable signal for feeding to light bar 34*a***.

Thus, the system of the invention offers substantial versatility in the way in which a motivational guidance display reflecting a desired and selected exercise regime can be programmed in the system for use.

While a different presentation format may, of course, be employed, the format selected for system 10 is one wherein, during a positive-motion portion of a cycle, the lighted area in each of the display bars climbs the bar, and, of course, lowers on the bar during a negative-portion of the cycle.

Figure 2:
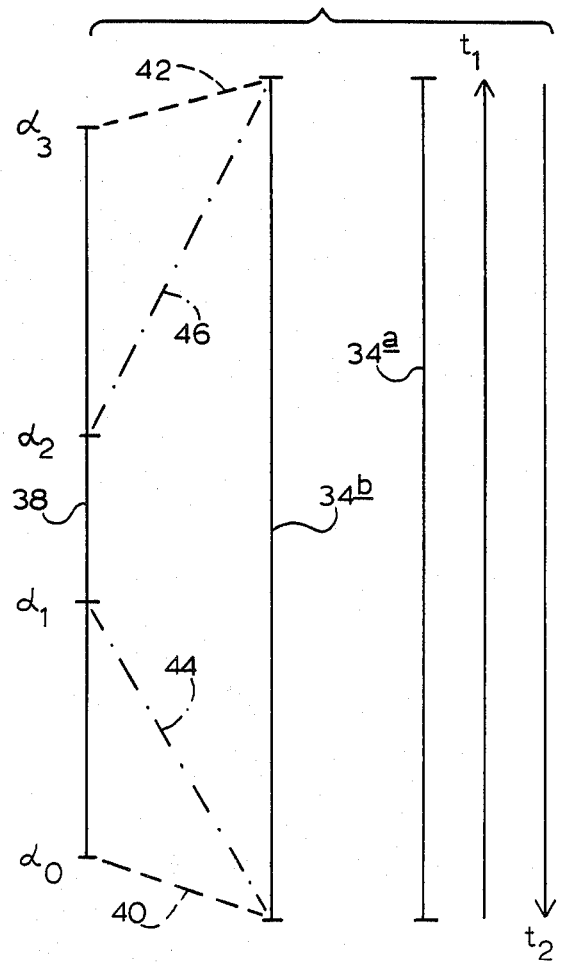
FIG. 2 is a schematic/graphic diagram which is used herein as an aide to illustrating the display presentation of certain exercise regime parameters.

Turning attention for a moment to FIG. 2, here, light bars **34*a*, 34*b*** are represented schematically by two, equal-length, side-by-side vertical lines in the figures. The small cross-bars at the upper and lower ends of these lines represent the vertical indicator limits of the bars.

To the right of the line representing bar **34*a*** are two other vertical lines, with the nearest line having an arrowhead at its upper end designated $t_1$, and with the next adjacent line having an arrowhead at its base designated $t_2$. The $t_1$ line is provided graphically to illustrate the time and motion during the weight-lifting part of a cycle, and line $t_2$ is intended to indicate the time and motion of the weight-lowering portion of a cycle. These parameters, of course, are programmed, as previously described, with appropriate rest or holding periods intervening, and in a selected number of sets of cycles, to define for the user the pattern, or regime, of exercise which has been selected for him or her to follow, as nearly exactly as possible.

For each different kind of exercise which is performable on a machine such as machine 12, such an exercise involves the angular relative motion of a pair of limbs about a joint, potentially up to a full range of angular motion. For each joint and pair of associated limbs in the body there is a defined or readily ascertainable "full range of angular motion" well known by those skilled with physical therapy.

In FIG. 2, a vertical line 38, whose upper and lower ends in the figure terminate by short cross-bars, is intended to represent the 100% full range of angular motion permitted between limbs at a selected joint in a person's body. Arbitrarily, one limit of angular motion, indicated at the lower end of line 38, is labeled angle $\alpha_0$, and the other extreme limit of motion, at the upper end of the line, is labeled angle $\alpha_3$.

One of the features of the preferred embodiment of the present invention, mentioned earlier, is that one using the system of the invention, and particularly one using the system under the direction of a therapist, can equate, to 100% of the display range of light bar **34*b* all or any portion of the full range of angular motion permitted around a particular joint. Thus, if the selected exercise regime in the illustration depicted in FIG. 2 is intended to flex the joint between angle $\alpha_0$ and angle $\alpha_3$, the computer in the system is instructed, in a manner well known to those skilled in the art, to relate these angular limits to the 100% range of light bar 34*b*. This situation is graphically suggested by dashed lines 40, 42**.

Two other intermediate angles within the full range of motion are illustrated along line 38 at angle $\alpha_1$ and angle $\alpha_2$. So, were the intended exercise regime to dictate exercise between angles $\alpha_1$ and $\alpha_2$, this portion of the full range of motion, as is illustrated by dash-dot lines 44, 46, would be related to the full 100% of display bar **34*b*. Likewise, were the portion to be exercised that between angle $\alpha_1$ and angle $\alpha_3$, this range would be related to 100% of the range of bar 34*b* as indicated by lines 42, 44**, and so on.

With the selected desired exercise regime programmed into the system, and the system set into an operating mode, a user, by manipulating lever 18, tries to produce along display bar **34*b* a display which, as closely as possible, matches the preprogrammed display presented by bar 34*a***.

In addition to the capabilities of system 10 so far described, other exercise parameters can be programmed into the system in order to provide useful data at the end of an exercise activity. For example, the weight of the weight stack which is being employed can be added, and from this, the system can calculate and make available information about the total amount of work which has been performed. This information, for example, could be presented in a display window made available in display unit 34. Another calculation which could be made would be an efficiency score that might reflect or give a measure of the exerciser's ability to keep up with the desired selected exercise regime.

A modification of the invention, which is particularly aimed at utility in the hands of a person directing a program of physical therapy, is a provision in computer 30 which, from the signals made available to the display unit, permits the calculation of charting data that can be fed to an outside printer for the purpose of preparing exercise performance charts. For example, according to this modification of the invention such charting data would be capable of producing graphs, for example, of angular position versus time, angular velocity versus time, and angular velocity versus angular position within the range of motion selected for an exercise. Shown at **30*c* in dashed lines within computer 30** is the modified portion thereof which is capable of producing such information. Programming for accomplishing this is well known to those skilled in the art.

From the descriptive information given above, read in conjunction with the two drawing figures, it should be apparent to those skilled in the art how the support system proposed by the present invention offers significant advantages in the use of a personal exercise machine, such as machine 12.

While a preferred embodiment of the invention, and certain modifications thereof, have been described herein, it is appreciated that other variations and modifications may be made without departing from the spirit of the invention.

It is claimed and desired to secure as Letters Patent:

1. An exercise/therapy structural support system for enabling real-time, comparative-display guiding of actual, personal exercise activity during use of exercise apparatus which includes a part that moves in a known relationship to such activity, said system comprising means for generating a selected, first displayable signal which is indicative of displacement and motion characterizing a desired exercise regime involving movement of such part generated by an actual exercise cycle as performed by a user, selectively attachable, sonar-based position and motion sensor means operatively coupled to such part, operable to produce a sensor signal which is interpretable to indicate the position and movement of the part, means operatively coupled to said sensor means, responsive to such a sensor signal for generating a second displayable signal which is indicative of displacement and motion characterizing an actual, real-time exercise regime involving movement of such part, and real-time, comparison-enabling display means operatively connected to said two generating means for receiving simultaneously the respective displayable signals generated thereby, and for producing therefrom respective associated real-time comparable displays which enable one using the apparatus, during and throughout exercise use, to compare the desired and the actual exercise regimes.

2. The system of claim 1 wherein said second-mentioned generating means is constructed to permit a full-scale display for any portion of any selected exercise regime.

3. The system of claims 1 or 2, wherein said two signal-generating means are constructed to produce, cooperatively, activity analysis charting signals useful for post-activity review.

* * * * *